US007813686B2

(12) United States Patent
Yagi et al.

(10) Patent No.: US 7,813,686 B2
(45) Date of Patent: Oct. 12, 2010

(54) TONER IMAGE FIXING DEVICE AND IMAGE FORMING APPARATUS

(75) Inventors: Masahiro Yagi, Ibaraki (JP); Yoshihiro Fukuhata, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 359 days.

(21) Appl. No.: 11/846,917

(22) Filed: Aug. 29, 2007

(65) Prior Publication Data

US 2008/0063442 A1 Mar. 13, 2008

(30) Foreign Application Priority Data

Sep. 8, 2006 (JP) ..... 2006-243901
Jun. 27, 2007 (JP) ..... 2007-169329

(51) Int. Cl.
*G03G 15/20* (2006.01)

(52) U.S. Cl. ..... 399/328; 399/330

(58) Field of Classification Search ..... 399/328, 399/333, 330, 320, 122
See application file for complete search history.

(56) References Cited

U.S. PATENT DOCUMENTS

2002/0085866 A1* 7/2002 Okayasu et al. ..... 399/328
2002/0141775 A1* 10/2002 Mitsuoka et al. ..... 399/69

FOREIGN PATENT DOCUMENTS

| | | |
|---|---|---|
| JP | 5-45738 | 6/1993 |
| JP | 8-314307 | 11/1996 |
| JP | 2002-318502 | 10/2002 |
| JP | 2003-98880 | 4/2003 |
| JP | 3506135 | 12/2003 |

* cited by examiner

*Primary Examiner*—David M Gray
*Assistant Examiner*—Billy J Lactaoen
(74) *Attorney, Agent, or Firm*—Oblon, Spivak, McClelland, Maier & Neustadt, L.L.P.

(57) ABSTRACT

A roller member includes a cylindrical core bar. The roller member is rotatably supported at both ends, and forms a nip, to which a recording medium is conveyed, by making a contact with another member. The core bar satisfies $1.0 \leqq \Delta D/D1 \times 100 \leqq 3.0$, where D1 is an outer diameter of the core bar in millimeters and ΔD is an outer diameter deformation value of a convey direction in millimeters.

20 Claims, 5 Drawing Sheets

FIG. 5

| | POINT | CORED BAR MATERIAL | MATERIAL YOUNG'S MODULUS | AXIAL DIRECTION LENGTH | LOAD | OUTER DIAMETER | THICKNESS | WUT | ΔD | CONVEY DIRECTION NIP WIDTH | ΔD / D | LONGEVITY | δ | δ / ΔD | CONVEY DIRECTION NIP WIDTH UNIFORMITY | VARIABLE DISTANCE FROM FIRST EMBODIMENT OF FIG. 5 |
|---|---|---|---|---|---|---|---|---|---|---|---|---|---|---|---|---|
| | | | Pa | mm | N | mm | mm | | mm | | % | | mm | | | |
| EMBODIMENT 1 | A1 | Fe | 2.07E+11 | 230 | 400 | 30 | 0.3 | GOOD | 0.62 | GOOD | 2.06 | GOOD | 0.26 | 0.43 | GOOD | – |
| EMBODIMENT 2 | A2 | Fe | 2.07E+11 | 230 | 400 | 35 | 0.4 | GOOD | 0.41 | GOOD | 1.18 | GOOD | 0.12 | 0.30 | GOOD | – |
| EMBODIMENT 3 | A3 | Fe | 2.07E+11 | 230 | 400 | 35 | 0.3 | GOOD | 0.97 | GOOD | 2.78 | GOOD | 0.16 | 0.17 | GOOD | – |
| EMBODIMENT 4 | A4 | Fe | 2.07E+11 | 230 | 400 | 25 | 0.27 | GOOD | 0.49 | GOOD | 1.96 | GOOD | 0.51 | 1.03 | GOOD | |
| EMBODIMENT 5 | A5 | Fe | 2.07E+11 | 230 | 400 | 40 | 0.4 | GOOD | 0.62 | GOOD | 1.54 | GOOD | 0.08 | 0.13 | GOOD | |
| COMPARATIVE EXAMPLE 1 | B1 | Fe | 2.07E+11 | 230 | 400 | 40 | 1 | BAD | 0.04 | GOOD | 0.10 | GOOD | 0.03 | 0.89 | GOOD | – |
| COMPARATIVE EXAMPLE 2 | B2 | Fe | 2.07E+11 | 230 | 400 | 20 | 0.3 | GOOD | 0.18 | BAD | 0.92 | GOOD | 0.90 | 4.91 | BAD | – |
| COMPARATIVE EXAMPLE 3 | B3 | Fe | 2.07E+11 | 230 | 400 | 20 | 1 | GOOD | 0.00 | BAD | 0.02 | GOOD | 0.30 | 65.15 | BAD | – |
| COMPARATIVE EXAMPLE 4 | B4 | Fe | 2.07E+11 | 230 | 400 | 40 | 0.2 | GOOD | 4.61 | BAD | 11.52 | BAD | 0.16 | 0.04 | GOOD | – |
| COMPARATIVE EXAMPLE 5 | B5 | Fe | 2.07E+11 | 230 | 400 | 25 | 0.3 | GOOD | 0.36 | GOOD | 1.43 | GOOD | 0.46 | 1.27 | BAD | |
| COMPARATIVE EXAMPLE 6 | B6 | Fe | 2.07E+11 | 230 | 400 | 35 | 0.2 | GOOD | 3.16 | BAD | 9.03 | BAD | 0.25 | 0.08 | GOOD | – |
| COMPARATIVE EXAMPLE 7 | B7 | Fe | 2.07E+11 | 230 | 400 | 40 | 0.3 | GOOD | 1.44 | BAD | 3.60 | BAD | 0.11 | 0.08 | GOOD | – |
| EMBODIMENT 1A | C1 | Fe | 2.07E+11 | 200 | 400 | 30 | 0.3 | GOOD | 0.71 | GOOD | 2.37 | GOOD | 0.19 | 0.26 | GOOD | 0.12 |
| EMBODIMENT 1B | C2 | Fe | 2.07E+11 | 260 | 400 | 30 | 0.3 | GOOD | 0.55 | GOOD | 1.82 | GOOD | 0.36 | 0.66 | GOOD | 0.12 |
| EMBODIMENT 1C | C3 | Fe1 | 1.45E+11 | 230 | 400 | 30 | 0.3 | GOOD | 0.88 | GOOD | 2.94 | GOOD | 0.38 | 0.43 | GOOD | 0.29 |
| EMBODIMENT 1D | C4 | Fe2 | 2.69E+11 | 230 | 400 | 30 | 0.3 | GOOD | 0.47 | GOOD | 1.58 | GOOD | 0.20 | 0.43 | GOOD | 0.15 |
| EMBODIMENT 1E | C5 | Fe | 2.07E+11 | 230 | 450 | 30 | 0.3 | GOOD | 0.69 | GOOD | 2.31 | GOOD | 0.30 | 0.43 | GOOD | 0.08 |
| EMBODIMENT 1F | C6 | Fe | 2.07E+11 | 230 | 350 | 30 | 0.3 | GOOD | 0.54 | GOOD | 1.80 | GOOD | 0.23 | 0.43 | GOOD | 0.08 |

TONER IMAGE FIXING DEVICE AND IMAGE FORMING APPARATUS

CROSS-REFERENCE TO RELATED APPLICATIONS

The present application claims priority to and incorporates by reference the entire contents of Japanese priority documents, 2006-243901 filed in Japan on Sep. 8, 2006 and 2007-169329 filed in Japan on Jun. 27, 2007.

BACKGROUND OF THE INVENTION

1. Field of the Invention

The present invention relates to an image forming apparatus and a fixing device installed therein that use a copier, a printer, and a facsimile or an electrophotographic method of a multifunction product (MFP) such as the copier, the printer, and the facsimile.

2. Description of the Related Art

In an image forming apparatus such as a copier and a printer, a commonly used fixing device in which a nip is formed by pressure welding a fuser roller and a pressure roller conveys to the nip, a recording medium that bears a toner image and fixes the toner image on the recording medium (for example, see Japanese Patent No. 3506135).

In such a fixing device, for shortening a warm-up time of a device by reducing a heat capacity, as a fuser roller and the pressure roller, a hollow structured roller member having a thin elastic layer on a core bar is widely used. Usually in the fuser roller, in addition to the core bar (a core bar layer) and the elastic layer, a releasing layer is formed on a surface.

In Japanese Patent Application Laid-Open No. 3506135, a technology is disclosed in which a supporting member is press-fit inside the fuser roller for enhancing a dent strength margin of the thin-walled hollow structured fuser roller.

Furthermore, in Japanese Patent Application Laid-Open No. 2002-318502, a technology is disclosed in which a pushing roller is installed inside the hollow structured pressure roller for preventing generation of wrinkles on the recording medium and a radius and a deflection value of a central portion of the pushing roller and a deflection value of a central portion of the fuser roller (heating roller) is optimized.

However, by using the commonly used fixing device, the warm-up time cannot be shortened, a good fixability, and a high-longevity cannot be obtained in a simple structure.

The warm-up time is a time required for a surface temperature of the fuser roller to reach up to a temperature necessary for a fixing process. The good fixability is obtained when a uniformity between a nip width (nip measurement) of the nip in a convey direction and the nip width in a rotating axial direction (a direction that is orthogonal to the convey direction) is adequately secured. The high-longevity can be obtained when a bonding between the core bar and the elastic layer is remained intact or a big deformation is not formed on the core bar and the elastic layer.

The inventor of the present application has realized after an investigation that the core bar structure of the fuser roller and the pressure roller that are considered as the roller members is significantly related to three features that are mentioned earlier.

For example, in the roller member, if an outer diameter of the core bar is large, even if the good nip width can be maintained, a long warm-up time is required. If the outer diameter of the core bar is small, even if the warm-up time can be shortened, the good nip width cannot be maintained. Furthermore, if the core bar is thick, even if the high-longevity can be obtained, the long warm-up time is required and the good nip width cannot be maintained. If the core bar is thin, even if the warm-up time can be shortened and the good nip width can be maintained, the high-longevity cannot be obtained.

In the technology disclosed in Japanese Patent No. 3506135, because the supporting member is press-fit in the thin-walled hollow structured fuser roller, the dent strength margin of the fuser roller is enhanced and a load bearing capacity of the fuser roller, and a speed of the fixing device can be increased. However, the structure of the fuser roller becomes complicated by press fitting the supporting member, thereby not enabling to directly resolve the problem mentioned earlier.

In the technology that is disclosed in Japanese Patent Application Laid-Open No. 2002-318502, by optimizing the radius and the deflection value of the central portion of the pushing roller that is installed inside the pressure roller and the deflection value of the central portion of the fuser roller (heating roller), generation of wrinkles on the recording medium are prevented. However, the structure of the fixing device becomes complicated due to installation of the pushing roller, thereby not enabling to directly resolve the problem mentioned earlier.

SUMMARY OF THE INVENTION

It is an object of the present invention to at least partially solve the problems in the conventional technology.

A device for fixing a toner image on a recording medium, according to one aspect of the present invention, includes a roller member that includes a cylindrical core bar. The roller member is rotatably supported at both ends, and forms a nip, to which a recording medium is conveyed, by making a contact with another member. The core bar satisfies $1.0 \leqq \Delta D/D1 \times 100 \leqq 3.0$, where D1 is an outer diameter of the core bar in millimeters and $\Delta D$ is an outer diameter deformation value of a convey direction in millimeters.

A device for fixing a toner image on a recording medium, according to another aspect of the present invention, includes a roller member that includes a cylindrical core bar. The roller member is rotatably supported at both ends, and forms a nip, to which a recording medium is conveyed, by making a contact with another member. The core bar satisfies $0.1 \leqq \delta/\Delta D \leqq 1.0$, where $\delta$ is a deflection value of a rotating axial direction in millimeters and $\Delta D$ is an outer diameter deformation value of a convey direction in millimeters.

An image forming apparatus according to still another aspect of the present invention includes a fixing device for fixing a toner image on a recording medium that includes a roller member including a cylindrical core bar. The roller member is rotatably supported at both ends, and forms a nip, to which a recording medium is conveyed, by making a contact with another member. The core bar satisfies $1.0 \leqq \Delta D/D1 \times 100 \leqq 3.0$, where D1 is an outer diameter of the core bar in millimeters and $\Delta D$ is an outer diameter deformation value of a convey direction in millimeters.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 5 is a table indicating experimental conditions and an experiment result of an experiment carried out for confirming effects of the present invention.

DETAILED DESCRIPTION OF THE PREFERRED EMBODIMENTS

Exemplary embodiments of the present invention are explained in detail below with reference to the accompanying drawings. In each of the drawings, a redundant explanation is suitably omitted by assigning a same code to a same or a corresponding unit.

In the present application, "roller member" is rotatably supported at both ends and a load on both the ends is increased. The roller member differs from a belt and a sleeve in which a uniformly distributed load is increased in an axial direction.

Figure 1:
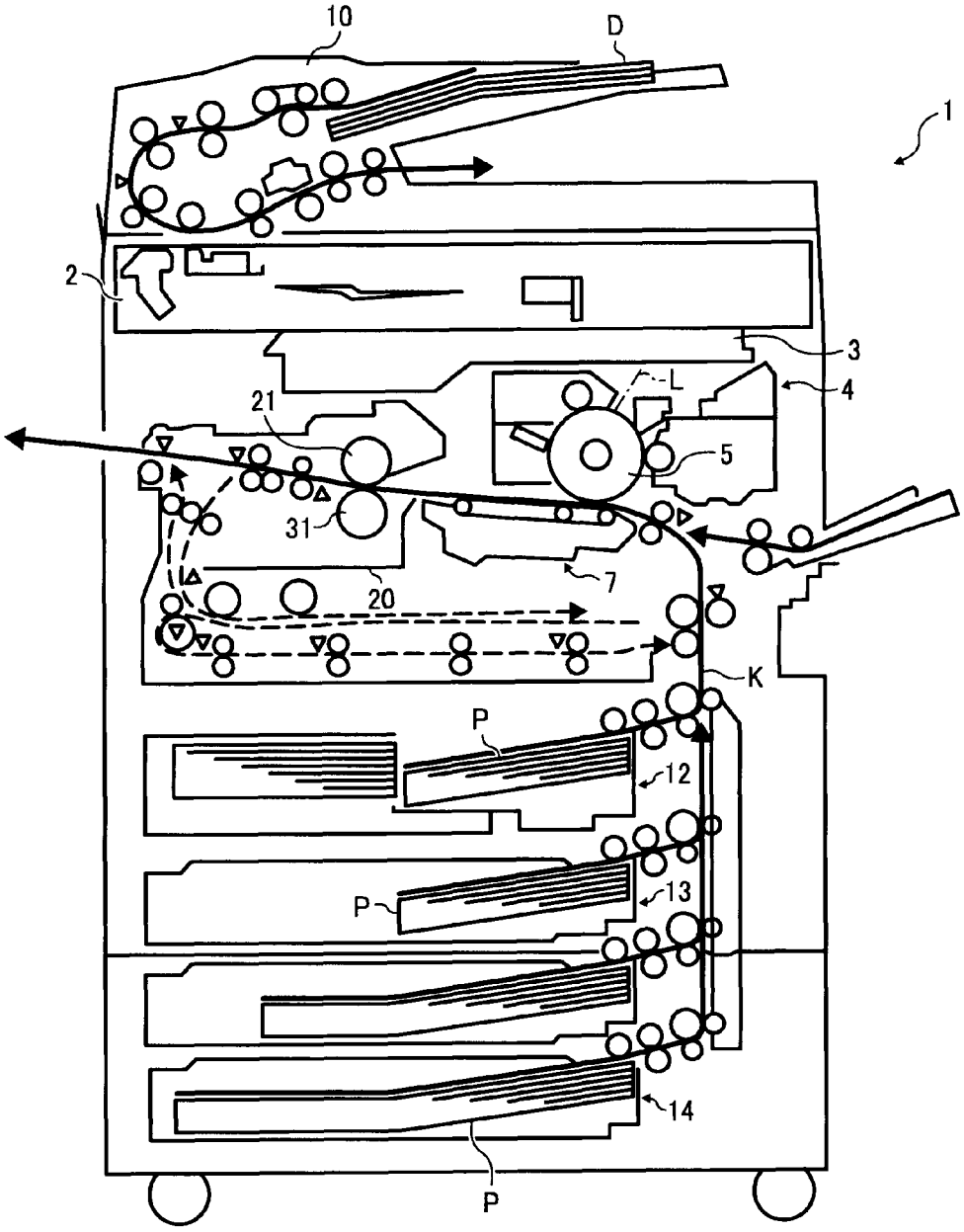
FIG. 1 is a schematic of an entire structure of an image forming apparatus according to an embodiment of the present invention.

FIG. 1 is a schematic of an entire structure and operations of an image forming apparatus.

In FIG. 1, 1 is a main body of a copier that is considered as the image forming apparatus, 2 is a manuscript reader that optically reads image data of a manuscript D, 3 is an exposing unit that radiates on a photosensitive drum 5 an exposed light L based on the image data read by the manuscript reader 2, 4 is an image forming unit that forms a toner image on the photosensitive drum 5, 7 is a transferring unit that transfers to a recording medium P, the toner image that is formed on the photosensitive drum 5, 10 is a manuscript conveyer that conveys the set manuscript D to the manuscript reader 2, 12 to 14 are paper feeders in which the recording medium P such as a transfer paper is housed, 20 is a fixing device that fixes unfixed images on the recording medium P, 21 is a fuser roller that is considered as the roller member and is installed in the fixing device 20, and 31 is a pressure roller that is considered as another member and is installed in the fixing device 20.

Normal operations of the image forming apparatus at the time of image formation are explained with reference to FIG. 1.

The manuscript D is conveyed from a manuscript stand in an arrow direction shown in a drawing using a conveying roller of the manuscript conveyer 10 and passed over the manuscript reader 2. The manuscript reader 2 optically reads the image data of the manuscript D passed thereon.

The optical image data that is read by the manuscript reader 2 is converted into electronic signals and transferred to the exposing unit 3 (writer). The exposed light L such as a laser beam that is based on the image data of the electronic signals is radiated from the exposing unit 3 on the photosensitive drum 5 of the image-forming unit 4.

In the image-forming unit 4, the photosensitive drum 5 rotates in a clock-wise direction and via predetermined image forming processes (such as a charging process, an exposing process, and a developing process), the image (toner image) that corresponds to the image data is formed on the photosensitive drum 5.

The image that is formed on the photosensitive drum 5 is transferred to the recording medium P that is conveyed by a resist roller to the transferring unit 7.

Operations of the recording medium P that is conveyed to the transferring unit 7 are explained below.

First, from a plurality of paper feeders 12, 13, 14, of the image forming apparatus main body 1, one paper feeder is automatically or manually selected (for example, a paper feeder 12 on the top is selected).

An uppermost paper of the recording medium P that is housed in the paper feeder 12 is conveyed towards a position of a conveying path K.

The recording medium P passes through the conveying path K and reaches the position of the resist roller. The recording medium P that has reached the position of the resist roller is conveyed to the transferring unit 7 at a timing such that the image that is formed on the photosensitive drum 5 matches with the position of the recording medium P.

Upon transfer process, the recording medium P passes through the position of the transferring unit 7 and reaches the fixing device 20 via the conveying path K. The recording medium P that has reached the fixing device 20 is inserted between the fuser roller 21 and the pressure roller 31. The image is fixed due to heat received from the fuser roller 21 and a pressure received from the fuser roller 21 and the pressure roller 31. Upon passing through a nip that is formed between the fuser roller 21 and the pressure roller 31, the recording medium P with the image fixed thereon is ejected from the image forming apparatus main body 1. A sequential image forming process is completed.

A structure and operations of the fixing device 20 that is installed in the image forming apparatus main body 1 are explained next.

Figure 2:
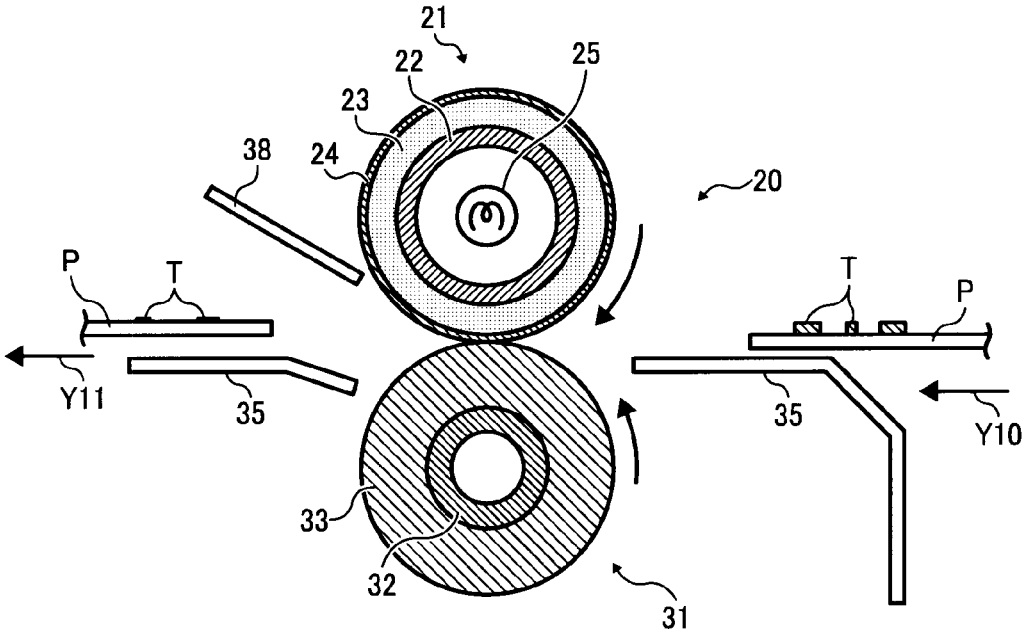
FIG. 2 is a schematic of a fixing device that is installed in the image forming apparatus that is shown in FIG. 1.

As shown in FIG. 2, the fixing device 20 includes the fuser roller 21, the pressure roller 31, a guide plate 35, and a separating plate 38.

The fuser roller 21 that is considered as the roller member is a thin-walled cylindrical body that rotates in the arrow direction that is shown in FIG. 2. A heater 25 (a heat source) is fixedly installed in the cylindrical body. The fuser roller 21 includes a multi-layered structure in which an elastic layer 23, a releasing layer 24 are sequentially laminated on a cylindrical core bar 22. The fuser roller 21 touches the pressure roller 31 that is considered as the other member and the nip is formed.

The core bar 22 of the fuser roller 21 is formed of a steel-type material such as SUS304 (Young's modulus is $1.5\times10^{11}$ to $2.7\times10^{11}$ Pascal (Pa)). According to the present embodiment, when an outer diameter of the core bar 22 before deformation is considered as D1 and a deformation value of the outer diameter of a convey direction is considered as $\Delta D$ millimeters, the core bar 22 is formed such that $\Delta D/D1\times100$ is greater than or equal to 1.0 and is equal to or less than 3.0. Due to this, the warm-up time can be shortened, and a good fixability and a high-longevity can be obtained. The shortening of the warm-up time and obtaining the good fixability and the high longevity are explained in detail in FIGS. 4 and 5.

According to the present embodiment, an axial direction length of the core bar 22 is set between 200 millimeters and 260 millimeters. When a deflection value of a rotating axial direction is considered as $\delta$ (millimeters) and the outer diameter deformation value of the convey direction is considered as ΔD (millimeters), the core bar 22 is formed such that δ/ΔD is greater than or equal to 0.1 and is equal to or less than 1.0. Upon increasing the deflection value δ, the nip width of the axial direction becomes uneven. Upon over-increasing the deflection value δ, the nip width in the central portion is likely to become zero. The outer diameter deformation value ΔD of the convey direction covers the deflected portion to uniformalize the nip width of the axial direction and the adequate nip width of the central portion of the axial direction can be secured. Thus, δ/ΔD needs to be set equal to or less than 1.0, thereby enabling to shorten the warm-up time and to obtain the good fixability and the high-longevity that is also explained in FIGS. 4 and 5.

Figure 3A:
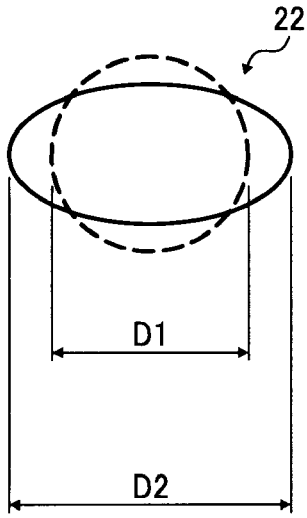
FIGS. 3A to 3B are schematics of a fuser roller explaining deformation of a convey direction and deflection of a rotating axial direction.

In FIG. 3A, the outer diameter deformation value ΔD (millimeters) of the convey direction of the core bar 22 can be calculated as ΔD=D2−D1. In an expression mentioned earlier, D1 is the outer diameter of the convey direction in the fuser roller 21 that is in an unloaded status. D2 is the outer diameter of the convey direction in the fuser roller 21 that is in a loaded status (status in which the pressure roller 31 is pressure-welded). In the structure in which both the ends of the core bar 22 are supported, the outer diameter deformation value ΔD of the convey direction of the core bar 22 is a value of an axial direction end.

Figure 3B:
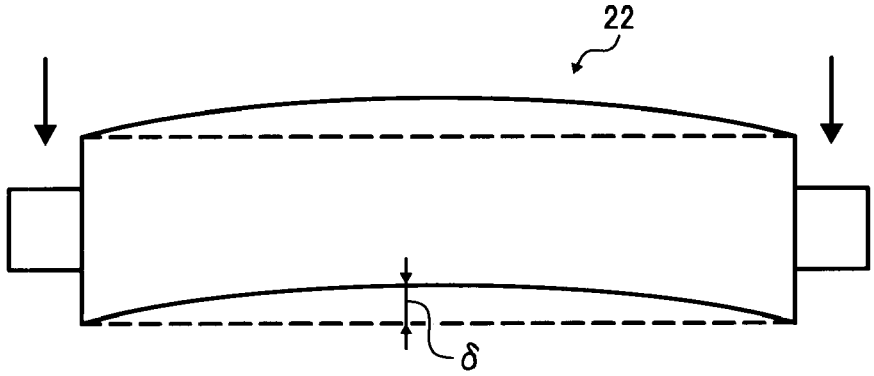

In FIG. 3B, the deflection value δ (millimeters) of the rotating axial direction of the core bar 22 is a maximum value of deflection of the core bar 22 in the direction away from the pressure roller 31 in the loaded status. According to the present embodiment, because the load is applied on both end shafts of the fuser roller 21 and the pressure roller 31, the central portion of the rotating axial direction of the core bar 22 maximally deflects.

The deflection value δ of the rotating axial direction or the deformation value ΔD of the convey direction can be measured by a laser depth recorder "LK-050" (manufactured by Keyence Corporation).

According to the present embodiment, the core bar 22 is formed such that ΔD is greater than or equal to 0.1 millimeters and is equal to or less than 1.0 millimeters. Due to this, effects mentioned earlier can be reliably obtained.

Furthermore, according to the present embodiment, when a thickness of the core bar 22 is considered as t (millimeters), forming the core bar 22 having t greater than or equal to 0.2 millimeters and equal to or less than 0.4 millimeters is desirable. Due to this, the effects mentioned earlier can be reliably obtained.

When the outer diameter of the core bar 22 is considered as D1 (millimeters), forming the core bar 22 having D1 greater than or equal to 25 millimeters and equal to or less than 40 millimeters is desirable. Due to this, the effects mentioned earlier can be reliably obtained.

Moreover, forming the core bar 22 having a tensile strength equal to or more than 700 MPa and a yield stress equal to or more than 600 MPa is desirable. Due to this, plastic deformation of the core bar 22 is suppressed and the high-longevity can be reliably obtained.

Furthermore, as the elastic layer 23 of the fuser roller 21, an elastic material such as fluorine-containing rubber, silicone rubber, and expandable silicon rubber is used. Especially when using silicon rubber as the elastic layer 23, a coating of the fluorine-containing rubber is desirable on the elastic layer 23 for improving a swelling resistance property.

By providing the elastic layer 23 on the core bar 22 of the fuser roller 21, a separating property of the recording medium P after passing through the nip can be enhanced and glossiness of an output image at the time of forming a color image can also be enhanced.

Forming the elastic layer 23 having the thickness equal to or less than 2 millimeters is desirable. Due to this, the warm-up time of the fixing device 20 can be shortened. According to the present embodiment, the thickness of the elastic layer 23 is set to 2 millimeters.

Forming the elastic layer 23 having a rubber hardness degree (Japanese Industrial Standard-A (JIS-A)) equal to or less than 8 hardness (Hs) is desirable. Due to this, the adequate nip width can be secured and the good fixability can also be obtained. According to the present embodiment, the rubber hardness degree (JIS-A) is set to 8 Hs.

Furthermore, forming the elastic layer 23 having a permanent deformation equal to or less than 4 percent is desirable. Due to this, reduction in the longevity of the fuser roller 21 (elastic layer 23) can be prevented. According to the present embodiment, the permanent deformation of the elastic layer 23 is set to 4 percent.

Figure 4:
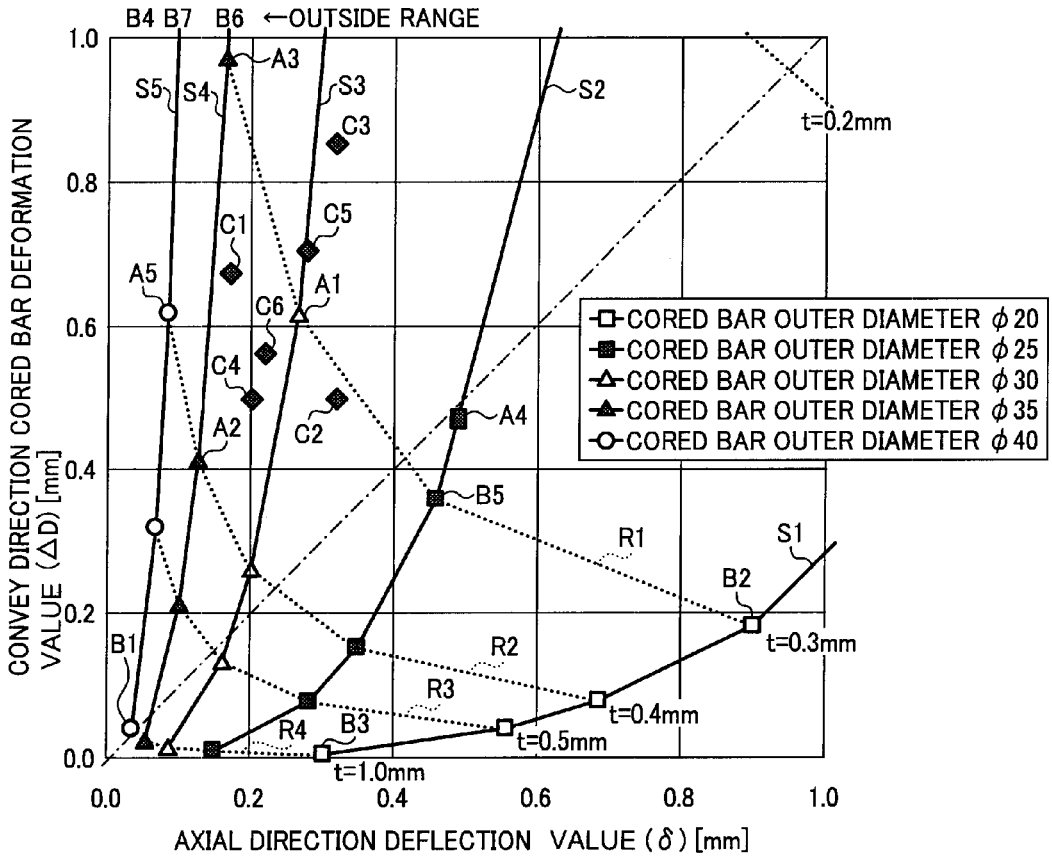
FIG. 4 is a graph indicating a relation between a deflection value of the rotating axial direction and a deformation value of the convey direction in a core bar of the fuser roller.

By forming the elastic layer 23 on the fuser roller 21, a concentric load is reduced due to deflection of the axial direction in the fuser roller 21 and the pressure is smoothly distributed. Because a maximum deflection value and a maximum deformation value of the fuser roller 21 is decreased, even if a graph (δ-ΔD curve) shown in FIG. 4 is completely shifted in a left downward direction, regardless of an availability of the elastic layer 23, a relation between the deflection value δ and the deformation value ΔD that is mentioned according to the present embodiment can be established.

Furthermore, as the releasing layer 24 of the fuser roller 21, tetrafluoroethylene perfluoroalkoxy vinyl ether copolymer (PFA), polymide, polyetherimide, and polyether sulphide (PES) can be used. By providing the releasing layer 24 on the surface of the fuser roller 21, a releasing property (detachability) with respect to a toner T (the toner image) can be secured. According to the present embodiment, a PFA tube having a layer thickness of 0.3 millimeter is used as the releasing layer 24.

The heater 25 of the fuser roller 21 is a rod shaped heater that includes a heating wire therein. Both the ends of the heater 25 are fixed to a side plate of the fixing device 20. The fuser roller 21 is heated by the heater 25 of which an output is controlled by power supply of the image forming apparatus main body 1. From the surface, heat is applied to the toner image T on the recording medium P. Based on a detection result of a roller surface temperature, the output control of the heater 25 is carried out by a thermistor (not shown in the drawing) that touches the surface of the fuser roller 21. By controlling the output of the heater 25, the temperature of the fuser roller 21 (fixing temperature) can be set to a desired temperature.

The pressure roller 31 includes a core bar 32 and an elastic layer 33 that is formed on an outer periphery of the core bar 32 via a bonding layer. The elastic layer 33 of the pressure roller 31 is formed of a material such as fluorine-containing rubber, silicone rubber, and expandable silicon rubber. A thin releasing layer that is formed of PFA can be provided as the surface layer of the elastic layer 33.

The pressure roller 31 is pressure-welded to the fuser roller 21 by a pressure mechanism that is not shown in the drawing. Due to this, the desired nip is formed between the pressure roller 31 and the fuser roller 21. According to the present embodiment, a setting is carried out such that the load of 400 Newton (N) can be applied to the fuser roller 21.

The guide plate 35 that guides for conveying the recording medium P is fixedly set at an inlet and an outlet of a contacting portion (the nip) of the fuser roller 21 and the pressure roller 31. The guide plate 35 is fixedly installed at the side plate of the fixing device 20.

The guide plate 35 faces an outer periphery of the fuser roller 21. The separating plate 38 is fixedly set in a vicinity of the outlet from the nip. The separating plate 38 prevents a wrapping of the recording medium P after the fixing process around the fuser roller 21 that is likely to occur due to rotations of the fuser roller 21.

Operations of the fixing device 20 that is structured as mentioned earlier are explained below.

Upon switching power supply of the image forming apparatus main body 1 on, electric power is supplied to the heater 25 and a rotary drive of the fuser roller 21 and the pressure roller 31 is started in the arrow direction that is shown in FIG. 2.

The recording medium P is fed from the paper feeders 12 to 14. In the image-forming unit 4, the unfixed images are borne on the recording medium P. The recording medium P that bears the unfixed image T (toner image) is conveyed in a direction of an arrow Y10 that is shown in FIG. 2 and is inserted in the nip of the pressure-welded fuser roller 21 and the pressure roller 31. Due to the heat applied by the fuser roller 21 and the pressure applied by the fuser roller 21 and the pressure roller 31, the toner image T is fixed on the recording medium P. The recording medium P that is passed through the nip due to the rotating fuser roller 21 and the pressure roller 31 is conveyed in the direction of an arrow Y11.

According to the present embodiment, in the fuser roller 21, the outer diameter D1 and the outer diameter deformation value ΔD of the core bar 22 is structured such that ΔD/D1× 100 is greater than or equal to 1.0 and is equal to or less than 3.0.

Furthermore, the rotating axial direction deflection value δ and the outer diameter deformation value ΔD of the convey direction of the core bar 22 is structured such that δ/ΔD is greater than or equal to 0.1 and is equal to or less than 1.0.

Due to this, in a relatively simple structure, the warm-up time of the fixing device 20 can be shortened and by securing the adequate nip width, good fixability, and the high-longevity can be obtained. From two expressions mentioned earlier, even if only one of the expressions is satisfied, the effects mentioned earlier can be obtained.

In FIGS. 3 and 4, the effects of the present embodiment are explained.

FIG. 4 is a graph (δ-ΔD curve) that indicates the relation between the deflection value δ of the rotating axial direction and the deformation value ΔD of the convey direction of the core bar 22 in the fuser roller 21.

In FIG. 4, a curve S1 is a δ-ΔD curve (deformation curve) when the outer diameter of the core bar 22 is 20 millimeters. A curve S2 is the δ-ΔD curve when the outer diameter of the core bar 22 is 25 millimeters. A curve S3 is the δ-ΔD curve when the outer diameter of the core bar 22 is 30 millimeters. A curve S4 is the δ-ΔD curve when the outer diameter of the core bar 22 is 35 millimeters. A curve S5 is the δ-ΔD curve when the outer diameter of the core bar 22 is 40 millimeters.

Furthermore, a dashed line R1 is the δ-ΔD curve (deformation curve) when the thickness of the core bar 22 is 0.3 millimeter. A dashed line R2 is the δ-ΔD curve when the thickness of the core bar 22 is 0.4 millimeter. A dashed line R3 is the δ-ΔD curve when the thickness of the core bar 22 is 0.5 millimeter. A dashed line R4 is the 6-ΔD curve when the thickness of the core bar 22 is 1.0 millimeter. Even if codes for curves mentioned below are omitted, the δ-ΔD curve when the thickness of the core bar 22 is 0.6 millimeter, the δ-ΔD curve when the thickness of the core bar 22 is 0.7 millimeter, the δ-ΔD curve when the thickness of the core bar 22 is 0.8 millimeter, the δ-ΔD curve when the thickness of the core bar 22 is 0.9 millimeter, and the δ-ΔD curve when the thickness of the core bar 22 is 1.0 millimeter are shown in a diagonally downward left direction in FIG. 4.

In FIG. 4, a dashed dotted line indicates an area where a ratio of the deflection value δ and the deformation value ΔD is one to one.

In the curve S1, B2 indicates the deformation value ΔD and the deflection value δ when the outer diameter of the core bar 22 is 20 millimeters and the thickness is 0.3 millimeter and B3 indicates the deformation value ΔD and the deflection value δ when the outer diameter of the core bar 22 is 20 millimeters and the thickness is 1.0 millimeter.

In the curve S3, A1 indicates the deformation value ΔD and the deflection value δ when the outer diameter of the core bar 22 is 30 millimeters and the thickness is 0.3 millimeter.

In the curve S4, A2 indicates the deformation value ΔD and the deflection value δ when the outer diameter of the core bar 22 is 35 millimeters and the thickness is 0.4 millimeter.

In the curve S5, B1 indicates the deformation value ΔD and the deflection value δ when the outer diameter of the core bar 22 is 40 millimeters and the thickness is 1.0 millimeter.

It can be understood from FIG. 4 that as the thickness of the core bar 22 increases, the deformation value ΔD of the convey direction or the deflection value δ of the rotating axial direction decreases. Furthermore, as the outer diameter of the core bar 22 increases, the deformation value ΔD of the convey direction increases and at the same time the deflection value δ of the rotating axial direction decreases. Especially in the dashed line R1, if the outer diameter of the core bar 22 is greater than or equal to 25 millimeters, the dotted dash line (a border line where the relation between the deformation value ΔD and the deflection value δ is one to one) lengthens and if the outer diameter is 30 millimeters, the deformation value ΔD is greater than the deflection value δ (ΔD>δ). Furthermore, it can be understood by referring to the dashed line R3 that upon increasing the thickness of the core bar 22 to 0.5 millimeter, the outer diameter that lengthens the dotted dash line becomes greater than 35 millimeters.

FIG. 5 is a table indicating experimental conditions and an experimental result of an experiment that is carried out for confirming the effects of the present embodiment.

In the experiment, deformation properties and fixing properties of the core bar 22 are evaluated for a first to fifth and 1A to 1F embodiments and comparative examples 1 to 7. To be specific, the warm-up time (WUT), the longevity, and the fixability (uniformity of the nip width of the convey direction and the nip width of the rotating axial direction) is evaluated. Furthermore, as the recording medium P, a cut paper of basic weight 55 grams per square centimeter (g/cm$^2$) is used and the full color image is formed on the recording medium P.

In FIG. 5, points A1 to A5, B1 to B3, B5, and C1 to C6 correspond to the points shown in FIG. 4. Because the points B4, B6, and B7 of the comparative example 4 are relatively greater than the deformation value ΔD, the points B4, B6, and B7 that not within a range of the curves S4 and S5 of the FIG. 4.

The WUT signifies the warm-up time. The WUT is mainly decided by the outer diameter, a material, and the thickness of the core bar 22 in the fuser roller 21, the thickness and the material of the elastic layer 23, and wattage of the heater. If the core bar 22 is thin and the outer diameter is small, the WUT can be shortened.

The nip width of the convey direction is decided by a load value, the rubber hardness and the thickness of the elastic layer 23, the outer diameter of the fuser roller 21, and the deformation value ΔD of the convey direction of the core bar 22. If the outer diameter of the core bar 22 of the fuser roller 21 and the deformation value ΔD are large, the adequate nip width of the convey direction can be secured.

The longevity is decided by a bonding status at a boundary surface of the core bar 22 and the elastic layer 23, the deformation value of the elastic layer 23, and the deformation value of the core bar 22. If the deformation value ΔD of the convey direction of the core bar 22 is small, the high-longevity can be obtained.

The nip width uniformity of the rotating axial direction is decided by the load value, the rubber hardness and the thickness of the elastic layer 23, and the axial direction deflection value δ of the core bar 22 and the convey direction deformation value ΔD. If the axial direction deflection value δ of the core bar 22 is smaller than the convey direction deformation value ΔD, the nip width uniformity of the rotating axial direction is enhanced.

From the experimental result shown in FIG. 5, in the fixing device 20 according to the first embodiment (the outer diameter of the core bar 22 of the fuser roller 21 is 30 millimeters and the thickness is 0.3 millimeter), a desirability of the WUT, the fixability, or the longevity can be confirmed.

In the comparative example 1, although the deformation value ΔD of the convey direction is reduced due to the large outer diameter of the core bar 22 and the thin core bar 22 and the high-longevity is obtained, a heat capacity of the fuser roller 21 is increased and the WUT is lengthened. Due to this the WUT is delayed.

In the comparative example 2, although the WUT is shortened due to the small outer diameter of the core bar 22 and the thin core bar 22, a contact area of the nip is reduced due to the small outer diameter of the fuser roller 21. Due to this, the nip width of the convey direction is narrowed and the nip width of the rotating axial direction is not uniform. Furthermore, because the axial direction deflection value δ is larger than the convey direction deformation value ΔD, the axial direction nip width is not uniform.

In the comparative example 3, the contact area of the nip width is reduced due to the small outer diameter of the core bar 22 and the thick core bar 22 and because the convey direction deformation value ΔD is negligible, the axial direction nip width is not uniform. Due to this, the nip width of the convey direction is narrowed and the nip width of the axial direction is not uniform.

In the comparative example 4, the convey direction deformation value ΔD is large, thus exceeding a threshold stress of the core bar 22. Due to this, the longevity is reduced.

Furthermore, in the experiment, the axial direction length 230 millimeters in the first embodiment is replaced by 200 millimeters and 260 millimeters in the embodiments 1A and 1B respectively. A core bar material iron (Fe) in the first embodiment is replaced by Fe1 and Fe2 in the embodiments 1C and 1D respectively. Fe1 is an iron-type material with relatively low Young's modulus such as monel metal and black heart malleable cast iron (FCMB360) and Fe2 is the iron-type material with relatively high Young's modulus such as nichrome (GNC108) and inconel 600 (NCF600). The load 400 N in the first embodiment is replaced by 450 N and 350 N in the embodiments 1E and 1F respectively.

In the present experiment, in either of the embodiments 1A to 1F, a variable distance from the first embodiment (FIG. 5) ΔR is within the range of the curves S2 and S5 that are shown in FIG. 4. Even if the structure of the first embodiment is changed, in other words, the axial direction length is replaced by 200 to 260 mm, or the core bar material is replaced by monel metal and inconel 600 (NCF600), or the load is replaced by 350 to 450 N, the effects similar to the effects according to the present embodiment can be obtained.

According to the present embodiment, for pressurizing the fuser roller 21 and the pressure roller 31, both the ends of both the roller members are supported by a respective bearing and a supporting unit is slanted by using a pressure spring. In the first to fifth and 1A to 1F embodiments, as the material of the core bar 22, the common steel-type material (SUS304) is used and the load value is considered as 350 N, 400 N, or 450 N. In the comparative examples 1 to 7, as the material of the core bar 22, the common steel-type material (SUS304) is used and the load value is considered as 400 N.

In such a structure, because both the ends of the roller member are supported, the roller member deflects on the rotating axial direction and deforms in an opposite side of a pressure direction in the central portion of the rotating axial direction. Due to such deformation property, the rotating axial direction deflection value δ is increased, a nip pressure in the central portion of the rotating axial direction is reduced, and the uniformity of the rotating axial direction nip width is deteriorated, thereby not enabling to obtain the adequate fixability.

However, according to the present embodiment, by optimizing the convey direction deformation value ΔD, deterioration of the nip width uniformity of the rotating axial direction can be prevented and the adequate fixability can be obtained.

Based on a result of the embodiments and the comparative examples shown in FIG. 5, when the outer diameter of the core bar 22 is considered as D1 and the outer diameter deformation value of the convey direction is considered as ΔD, the core bar 22 is formed such that ΔD/D1×100 is greater than or equal to 1.0 and is equal to or less than 3.0. Thus, the warm-up time can be shortened and the good fixability, and the high-longevity can be obtained.

Based on the result of the embodiments and the comparative examples shown in FIG. 5, when the deflection value of the rotating axial direction is considered as δ (millimeters) and the outer diameter deformation value of the convey direction is considered as ΔD (millimeters), the core bar 22 is formed such that δ/ΔD is greater than or equal to 0.1 and is equal to or less than 1.0. In the expression mentioned earlier, in the fixing device 20, the shortening of warm-time is negligible as compared to the good fixability and the high-longevity. Due to this, the result (δ/ΔD=0.89) of the comparative example is included in an upper limit of the δ/ΔD. However, for shortening the warm-up time and for obtaining the good fixability and the high-longevity, forming the core bar 22 having δ/ΔD greater than or equal to 0.1 and equal to or less than 0.89 is desirable.

By considering a durability of the core bar 22, forming the core bar 22 having ΔD greater than or equal to 0.1 millimeters and equal to or less than 1.0 millimeters is desirable.

Based on the result of the embodiments and the comparative examples shown in FIG. 5, forming the core bar 22 having ΔD greater than or equal to 0.36 millimeters and equal to or less than 0.97 millimeters is desirable.

Based on the result of the embodiments and the comparative examples shown in FIG. 5, when the thickness of the core bar 22 is considered as t (millimeters), forming the core bar 22 having t greater than or equal to 0.2 or equal to or less than 0.4 is desirable.

Based on the result of the embodiments and the comparative examples shown in FIG. 5, when the outer diameter of the core bar 22 is considered as D1 (millimeters), forming the core bar 22 having D1 greater than or equal to 25 or equal to or less than 40 is desirable.

When the first and the second embodiments are compared, it is confirmed that as compared to the first embodiment, the good longevity can be obtained for a fixing device 6 (the outer diameter of the core bar 22 is 35 millimeters and the thickness is 0.4 millimeter) according to the second embodiment. Depending upon the combination of the material, the threshold stress of the common steel-type material is 700 to 250 MPa and the threshold stress can be attained when the convey direction deformation value ΔD is 1.00 millimeter to 0.5 millimeter. However, when a standard longevity is long, as indicated in the second embodiment, it is desirable to set the ratio of the axial direction deflection value δ and the convey direction deformation value ΔD within the range mentioned earlier by controlling reduction of the convey direction deformation value ΔD and setting the ratio ΔD/D1 between the convey direction deformation value ΔD and the outer diameter D1 to greater than or equal to 1.0 percent.

According to the present embodiment, because the outer diameter deformation value ΔD of the convey direction of the core bar 22 is optimized in the fuser roller 21 (roller member) that forms the nip, the warm-up time can be shortened, the good fixability and the high-longevity can be obtained in the simple structure.

Even if the present invention is applicable to the fixing device 20 employing a heat roller method according to the present embodiment, the present invention is also applicable to the fixing device 20 employing another method such as an electromagnetic induction heating method, thereby enabling to obtain the effects similar to the effects according to the present embodiment.

Even if the present invention is applicable to the fuser roller 21 that is considered as the roller member according to the present embodiment, the present invention is also applicable to the pressure roller 31 that is also considered as the roller member. In other words, in the pressure roller 31 (roller member) that forms the nip, by optimizing the outer diameter deformation value ΔD of the convey direction of the core bar 32, the effects similar to the effects according to the present invention can be obtained. The pressure roller 31 functions as the other member that forms the nip by touching the fuser roller 21.

The present invention is not limited to the present embodiment. The present embodiment can be suitably modified within the range of technical aspects mentioned in the present invention. Without limiting to the present embodiment, a number, a position, and a shape of a structure member can be changed to a desired number, a position, and a shape.

The inventor of the present application has realized after an investigation for solving problems that in a roller member that forms a nip, by deforming a cylindrical core bar and optimizing an outer diameter deformation value ΔD of a convey direction of the core bar, a warm-up time can be shortened and a good fixability and a high-longevity can be obtained.

As described above, according to one aspect of the present invention, an outer diameter deformation value ΔD of a convey direction of a core bar is optimized in a roller member that forms a nip, thereby enabling to provide a fixing device and an image forming apparatus in which a warm-up time can be shortened and a good fixability and a high-longevity can be obtained in a simple structure.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A device for fixing a toner image on a recording medium, the device comprising:

a roller member that includes a cylindrical core bar, the roller member being rotatably supported at both ends and forming a nip, to which a recording medium is conveyed, by making a contact with another member, wherein the core bar satisfies $1.0 \leqq \Delta D/D1 \times 100 \leqq 3.0$, where D1 is an outer diameter of the core bar in millimeters and ΔD is an outer diameter deformation value, due to contact between the roller member and the other member, of a convey direction in millimeters.

2. The device according to claim 1, wherein the core bar further satisfies $0.1 \leqq \delta/\Delta D \leqq 1.0$, where δ is a deflection value of a rotating axial direction in millimeters.

3. The device according to claim 1, wherein the core bar further satisfies 0.1 millimeters$\leqq \Delta D \leqq$1.0 millimeters.

4. The device according to claim 1, wherein the core bar further satisfies 0.2 millimeters$\leqq t \leqq$0.4 millimeters, where t is a thickness of the core bar in millimeters.

5. The device according to claim 1, wherein the core bar further satisfies 25 millimeters$\leqq$D1$\leqq$40 millimeters.

6. The device according to claim 1, wherein a tensile strength of the core bar is equal to or more than 700 MPa, and a yield stress of the core bar is equal to or more than 600 MPa.

7. The device according to claim 1, wherein the roller member includes an elastic layer on the core bar.

8. The device according to claim 7, wherein a thickness of the elastic layer is equal to or less than 2 millimeters.

9. The device according to claim 7, wherein a Japanese Industrial Standards rubber hardness degree of the elastic layer is equal to or less than 8 Hs.

10. The device according to claim 7, wherein a permanent deformation of the elastic layer is equal to or less than 4%.

11. A device for fixing a toner image on a recording medium, the device comprising:

a roller member that includes a cylindrical core bar, the roller member being rotatably supported at both ends and forming a nip, to which a recording medium is conveyed, by making a contact with another member, wherein the core bar satisfies $0.1 \leqq \delta/\Delta D \leqq 1.0$, where, due to contact between the roller member and the other member, δ is a deflection value of a rotating axial direction in millimeters and ΔD is an outer diameter deformation value of a convey direction in millimeters.

12. The device according to claim 11, wherein the core bar further satisfies 0.1 millimeters$\leqq \Delta D \leqq$1.0 millimeters.

13. The device according to claim 11, wherein the core bar further satisfies 0.2 millimeters$\leqq t \leqq$0.4 millimeters, where t is a thickness of the core bar in millimeters.

14. The device according to claim 11, wherein the core bar further satisfies 25 millimeters$\leqq$D1$\leqq$40 millimeters, where D1 is an outer diameter of the core bar in millimeters.

15. The device according to claim 11, wherein a tensile strength of the core bar is equal to or more than 700 MPa, and a yield stress of the core bar is equal to or more than 600 MPa.

16. The device according to claim 11, wherein the roller member includes an elastic layer on the core bar.

17. The device according to claim 16, wherein a thickness of the elastic layer is equal to or less than 2 millimeters.

18. The device according to claim 16, wherein a Japanese Industrial Standards rubber hardness degree of the elastic layer is equal to or less than 8 Hs.

19. The device according to claim 16, wherein a permanent deformation of the elastic layer is equal to or less than 4%.

20. An image forming apparatus comprising:

a fixing device for fixing a toner image on a recording medium that includes a roller member including a cylindrical core bar, the roller member being rotatably supported at both ends and forming a nip, to which a recording medium is conveyed, by making a contact with another member, wherein the core bar satisfies $1.0 \leqq \Delta D/D1 \times 100 \leqq 3.0$, where D1 is an outer diameter of the core bar in millimeters and $\Delta D$ is an outer diameter deformation value, due to contact between the roller member and the other member, of a convey direction in millimeters.

* * * * *